United States Patent [19]

Smuckler

[11] Patent Number: 4,668,857

[45] Date of Patent: May 26, 1987

[54] TEMPERATURE SELF-REGULATING RESISTIVE HEATING ELEMENT

[75] Inventor: Jack H. Smuckler, Marblehead, Mass.

[73] Assignee: Belton Corporation, Belton, S.C.

[21] Appl. No.: 766,642

[22] Filed: Aug. 16, 1985

[51] Int. Cl.[4] ..... H05B 3/12

[52] U.S. Cl. ..... 219/549; 219/553; 338/22 R

[58] Field of Search ..... 219/549, 504, 505, 544, 219/553, 541, 528, 548, 553; 338/22 R, 229 D; 156/51; 252/511

[56] References Cited

U.S. PATENT DOCUMENTS

| | | | |
|---|---|---|---|
| 3,243,753 | 11/1962 | Kohler | 338/31 |
| 3,338,476 | 8/1967 | Marcoux | 222/146 |
| 3,410,984 | 11/1968 | Sandford et al. | 219/212 |
| 3,413,442 | 11/1968 | Buiting et al. | 219/390 |
| 3,435,401 | 3/1969 | Epstein | 338/214 |
| 3,673,121 | 6/1972 | Meyer | 252/511 |
| 3,733,385 | 5/1973 | Reddish | 252/511 |
| 3,823,217 | 7/1974 | Kampe | 264/105 |
| 3,836,482 | 9/1974 | Ling et al. | 252/511 |
| 3,858,144 | 12/1974 | Bedard et al. | 338/22 R |
| 3,861,029 | 1/1975 | Smith-Johannsen et al. | 29/611 |
| 3,914,363 | 10/1975 | Bedard et al. | 264/105 |
| 3,976,600 | 8/1976 | Meyer | 252/511 |
| 4,150,193 | 4/1979 | Burns, Jr. | 252/511 |
| 4,237,441 | 12/1980 | van Konynenburg et al. | 338/22 |
| 4,271,350 | 6/1981 | Crowley | 219/549 |
| 4,277,673 | 7/1981 | Kelly | 219/528 |
| 4,309,597 | 1/1982 | Crowley | 219/549 |
| 4,314,145 | 2/1982 | Horsma | 219/553 |
| 4,318,881 | 3/1982 | Sopory | 264/105 |
| 4,330,703 | 5/1982 | Horsma et al. | 219/553 |
| 4,334,148 | 6/1982 | Kampe | 219/504 |
| 4,334,351 | 6/1982 | Sopory | 264/105 |
| 4,350,652 | 9/1982 | Thezsohn et al. | 264/104 |
| 4,400,250 | 9/1968 | Buiting et al. | 219/141 |
| 4,400,614 | 8/1983 | Sopory | 219/528 |
| 4,459,473 | 7/1984 | Kamath | 219/549 |
| 4,503,322 | 3/1985 | Kishimoto et al. | 219/549 |
| 4,520,260 | 5/1985 | Kotian et al. | 338/22 R |
| 4,543,474 | 9/1985 | Horsma et al. | 219/553 |
| 4,560,524 | 12/1985 | Smuckler | 264/105 |

*Primary Examiner*—M. Jordan

*Attorney, Agent, or Firm*—Lahive & Cockfield

[57] ABSTRACT

Disclosed is an improved temperature self-regulating resistive heating element and a method for its fabrication. The element utilizes a positive temperature coefficient (PTC) composition comprising a blend of two partially incompatible crystalline polymers of differing melting points and an electrically conductive filler. The PTC composition does not deform during annealing, this permitting the fabrication of temperature self-regulating resistive heating element with electrodes spaced-apart by not more than 0.100 inch. Heating elements provided by the invention have a smaller cross section, are more flexible, and are less expensive to fabricate than similar prior art elements.

18 Claims, 2 Drawing Figures

TEMPERATURE SELF-REGULATING RESISTIVE HEATING ELEMENT

BACKGROUND OF THE INVENTION

This invention relates to temperature self-regulating electric heating elements and to methods of manufacture of such elements. More particularly, the invention relates to a novel temperature self-regulating electric heating elements employing positive temperature coefficient (PTC) compositions which do not deform during annealing and which are smaller, more flexible, and less expensive to manufacture than similar prior art elements.

PTC compositions and devices which exploit them are well known in the art. The compositions are ideally suited to take part in temperature self-regulating circuit elements, since their electrical conductivity varies with temperature. At relatively low temperatures, a constant voltage applied across a PTC composition evokes a stable flow of current. As the temperature of the PTC composition increases, due to resistive heating, the resistivity gradually increases, until the composition reaches a "switching" temperature or temperature range. At the switching temperature, the compositions' resistance increases dramatically—six fold or more—resulting in greatly decreased current flow.

PTC compositions consist of blends of crystalline polymers and conductive filler materials, such as carbon black. See, e.g., U.S. Pat. No. 3,410,984. Early PTC compositions, such as those disclosed in U.S. Patent No. 3,976,600 required up to 50% conductive carbon black in order to obtain the PTC effect. When such high carbon black loadings were used, a fairly sharp switching temperature was achieved, but the resulting blend was inflexible and deteriorated upon repeated thermal cycling. Lower levels of carbon black loading were tried, as, for example, in U.S. Pat. No. 3,861,029, which disclosed the use of less than 13% by weight carbon black. A drawback with this approach was that the volume resistivity of the carbon loaded material was too high.

A later discovery showed that the volume resistivities of PTC compositions with low levels of carbon black were reduced from approximately $10^9$ ohm-cm to $10^3$ ohm-cm through annealment at temperatures of 250° F. or higher for periods of about 24 hours. A heating unit constructed utilizing this discovery is disclosed in U.S. Pat. No. 3,861,029 and consists of a polymer-carbon black blend extruded onto a spaced-apart pair of elongate electrodes to form an element dumbbell-shaped in cross section. The extruded PTC formulation both encapsulated and inter-connected the two wires. The two wires were spaced apart by approximately 0.25 inches. The element thereafter was jacketed with a high-melting thermoplastic composition so that when the product reel was annealed, it would not melt, flow, and stick to itself.

The annealment discovery created yet another problem. Specifically, during the annealing phase, when the PTC composition is in a fluid state, the electrodes have greater freedom of motion and are often displaced from their desired positions. An attempt to solve this problem is disclosed in U.S. Pat. No. 4,271,350, where a spacer is inserted between the electrode wires during extrusion of the PTC composition. While a spacer can prevent the two electrode wires from actually touching, the wires may still move very close to each other, causing a hot spot during operation of the heating element. Also, the wires can move away from each other, causing a cool spot during operation of the element.

Prior to the present invention, the only known solutions to the problem of annealment phase electrode displacement—wide electrode separation or the use of spacers —have precluded fabrication of narrow, flexible, and uniformly heated PTC devices. Accordingly, the object of this invention is to provide such a device.

SUMMARY OF THE INVENTION

A temperature self-regulating resistive heating element according to the invention satisfies the above-mentioned and other objects by providing, in one aspect, a heating element with two electrodes separated by not more than 0.100 inch. The electrodes are in electrical communication with a PTC composition comprising a blend of a conductive filler material and two partially incompatible crystalline polymers having differing melting points.

In another aspect, the invention provides a temperature self-regulating resistive heating element comprising an insulating material enclosing two elongate electrodes separated by, and in electrical contact with, a PTC composition made up of a crosslinked blend of two partially incompatible crystalline polymers of differing melting points and not more than 25% by weight carbon black.

In yet another aspect, the invention provides a temperature self-regulating resistive heating element comprising a single elongate electrode coated with a layer of PTC composition similar to that described in the previous paragraph, and further coated with a second layer of conductive material made up of a crosslinked blend of a high-temperature melting point polymer and 30% by weight carbon black. A second, elongate electrode is spirally wound about the conductive material and the entire product jacketed in a flexible insulating material.

In still another aspect, the invention provides a method of fabricating the temperature self-regulating resistive heating elements described above.

An object of the present invention is, therefore, to provide a compact, flexible temperature self-regulating resistive heating element which produces uniform heat output over its entire length. A second object of the invention is to provide a temperature self-regulating heating element with uniformly spaced electrode wires separated by not more than 0.100 inch. The third object of the invention is to provide a temperature self-regulating heating element utilizing a PTC composition which does not deform during annealing. Still another object of the invention is to provide a compact, flexible temperature self-regulating heating element which is inexpensive and may be used in heating pads, heating blankets, and other similar devices. Other objects and features of the invention are evident throughout the following sections.

BRIEF DESCRIPTION OF THE DRAWING

A more complete understanding of the invention may be attained by examination of the drawing, in which.

DESCRIPTION

Figure 1:
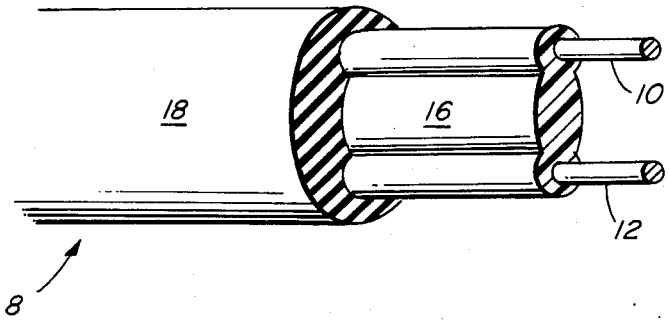
FIG. 1 shows one embodiment in which the electrodes are disposed in parallel within the PTC composition.

The invention is based, in part, upon the discovery that a PTC composition comprising a mixture of a conductive filler and two partially incompatible, crystalline polymers of differing melting points can be annealed without substantial softening. This discovery makes possible the manufacture of temperature self-regulating resistive heating elements with closely and uniformly spaced electrodes, thereby providing uniform heating over the length of the element. The resulting elements additionally are smaller, more flexible, and less expensive than those provided by the prior art.

In pursuit of the invention, experimentation revealed that certain PTC compositions comprising dual polymer blends do not have the desired annealment phase non-deformation characteristic. For example, a PTC composition comprising a low temperature melting point crystalline polymer and a high temperature melting point non-crystalline polymer, incompatible with the crystalline polymer, was found to deform and soften during the annealment phase. Here, an exemplar PTC composition comprised low density polyethylene, DuPont's Hytrel, and carbon black.

In contrast to the results described above, further experimentation revealed that a PTC composition which comprises two partially incompatible crystalline polymers of differing melting points attains the desired characteristics. The blend neither substantially softens or deforms when annealed at temperatures close to, but lower than, the melting point temperatures of the higher melting polymer. In one example of this discovery, a low density polyethylene blended with a crystalline fluorinated polyvinylidene (Pennwalt's Kynar) and carbon black was used to form a PTC composition, which, during annealing, did not permit electrode movement. In a second example of the discovery, a low density polyethylene blended with polypropylene and carbon black was also used to form a PTC composition, which during annealment did not permit electrode movement.

More generally, the characteristics of the preferred polymer blends are as follows: both polymers must be crystalline, the polymers must be partially incompatible with each other, and the melting points of the polymers must differ. The crystallinity of each polymer must be at least 20%, and preferably at least 50%, as determined by x-ray diffraction. With regard to a polymer's melting point, the term denotes the temperature at which no crystals remain within the polymer, as determined by x-ray diffraction. Practice of the invention requires the variance in melting points be at least 20° F., and more preferably 50° F. Two polymers are deemed partial incompatible if, in blend, their melting points can be separately detected by thermal analysis.

Polymer blends suitable for practice of the invention may contain polyolefins, fluorocarbon polymers or copolymers, and terpolymers containing non-conjugated dienes. The following specific dual polymer combinations are non-limiting examples of suitable polymer blends:

1. low density polyethylene, polyvinylidene fluoride;
2. low density polyethylene, fluorinated ethylene propylene;
3. low density polyethylene, chlorotrifluoroethylene;
4. low density polyethylene, poly (ethylenechlorotrifluoroethylene);
5. polypropylene, tetrafluoroethylene;
6. low density polyethylene, polypropylene;
7. polypropylene, fluorinated ethylene/propylene;
8. polypropylene, chlorotrifluoroethylene; and
9. polypropylene, poly (ethylenechlorotrifluoroethylene).

As used herein, a low density polyethylene is one having a density less than 0.930.

The relative proportions of each polymer in the blend are adjusted so that the blend does not soften or deform during the annealing step. In some cases as little as 25% of the high melting polymer will be required. In other cases, as much as 75% high melting polymer will be required.

With regard to the conductive filler used in the PTC blend, a suitable filler is high structure furnace black, though, more generally, other carbon blacks may be used. By way of background, carbon blacks are one of a group of materials having the ability to impart electrical conductivity to polymer systems. As discussed in chapter 4 of "Conductive Rubbers and Plastics", R. H. Norman (American Elsevier, 1970), carbon blacks tend to be found, not as individual particles, but rather as chain-like structures. High structure carbon blacks, that is, those with long chains of particles such as Cabot Corporation's Vulcan XC-72 (the most commonly used carbon black in PTC compositions), impart greater electrical conductivity to polymer systems than do low structured carbon blacks, that is, those with short chains (such as, Cabot Corporation's Regal 300 or Regal 660). Carbon blacks may also include chemisorbed oxygen compounds on their surfaces. The greater the amount of chemisorbed oxygen compounds, the lower the conductivity. The highly electrically resistive carbon blacks disclosed in Patent No. 4,277,673 have a large concentration of chemisorbed oxygen compounds. These carbon blacks do not conduct electricity well, irrespective of their high or low structure, because of the chemisorbed compounds.

With particular regard to practice of the invention, the PTC composition should comprise less than 25%, and preferably less than 14%, by weight carbon black.

The PTC composition is blended generally as disclosed in the prior art. See, for example, U.S. Pat. Nos. 4,277,673 and 3,410,984, the disclosures of which are incorporated herein by reference. Thus, a crystalline polymer mixture selected in accordance with the teachings set forth above is mixed with a carbon black, in a heated, high-intensity mixer. Typically, a substance which accelerates formation of cross links induced by irradiation will also be included. Antioxidants and other conventional additives may also be introduced. The components are mixed for at least five minutes to optimize homogeneity of the resulting composition. The composition is then fed to a dicer in preparation for extrusion.

After blending, the PTC composition and electrodes are placed together to form the heating element. Typically, this phase of fabrication is performed by extruding the composition over the elongate electrodes. Use of a PTC composition of the type revealed by the invention permits close spacing of electodes without creating the potential for short-circuiting or uneven heating. In the heating element revealed by the invention and shown in the configurations discussed below, electrode spacing does not exceed 0.100 inch.

Following extrusion, the product is annealed to reduce the volume resistivity of the PTC composition to the desired level, generally a level less than approximately 20,000,000 ohm-cm, and preferably 1,000,000 ohm-cm. The annealing temperature is selected between the melting point temperatures of the two polymers, and preferably as close as possible to the higher of the two polymers' melting point temperatures. In order to produce an element having greater stability, the PTC composition may be cross-linked after annealing. In the preferred embodiment, cross-linking is effected through irradiation.

Fabrication of heating element reels is facilitated by applying an insulating layer to the PTC-electrode extrudate prior to annealing. This layer serves to prevent sticking during the annealing phase. The insulating material is typically a polymer and must have a softening point above the annealing temperature. Suitable polymers are polyesters, fluorocarbon polymers, and terpolymers containing non-conjugated dienes.

The precise values of the room-temperature volume resistivity and switching temperature volume resistivity of the resultant resistive heating element will differ dependent upon the type and percent loading of the carbon black employed, the type of polymer blend used as the matrix material, and the thickness of the PTC layer separating the electrodes. For any given resistive heating element, the change in volume resistivity within the temperature range of use, approx. 0°-95° C., is substantially uniform after annealing and cross-linking. Typically, PTC compositions formulated as disclosed herein will have a volume resistivity greater than about $10^7$ ohm-cm before annealing, and a volume resistivity less than $10^6$ ohm-cm after thermal treatment.

For electric blanket and heating pad manufacture, a preferred temperature self-regulating heating element will have a power consumption in operation in the vicinity of 0.5-1.5 watt/foot. For standard U.S. 120 volt house current, a PTC material of 14,400 ohms per foot at operating temperature will result in a power consumption of 1.0 watt. This resistance value is achieved, for example, in a cable wherein the electrodes are separated by a distance of 0.100 inch and the PTC composition is 0.020 inch thick, by employing a PTC composition having a volume resistivity of 87,800 ohm-cm at the operational equilibrium temperature. It is understood that the PTC composition resistance will be significantly lower at room temperature.

FIG. 1 is a perspective view of a temperature self-regulating resistance heating element produced in accord with the above method. Electrodes 10 and 12 of resistive heating element 8 are parallel and separated by PTC composition 16, which was applied by extrusion. The spacing of electrodes 10 and 12 is less than 0.250 inch, preferably less than 0.100 inch, and remains constant during the annealing stage. Insulating layer 18 consists of a polymer of the type listed above and prevents the product from sticking to itself during the annealing step.

In the operation of this embodiment, current flows between the electrodes 10 and 12 via PTC composition 16, causing resistive heating. This heating raises the temperature of the PTC composition 16 until its switching temperature is reached. At that temperature, the resistance of the PTC compostion 16 increases dramatically thereby shutting off or greatly reducing the current between electrodes 10 and 12. As the current decreases, the resistive heating also decreases and the temperature of the PTC composition 16 declines. When the temperature of the PTC composition 16 falls below the switching temperature, the resistance decreases and the current again increases. This thermal cycling allows the element to act as a temperature self-regulating device.

Figure 2:
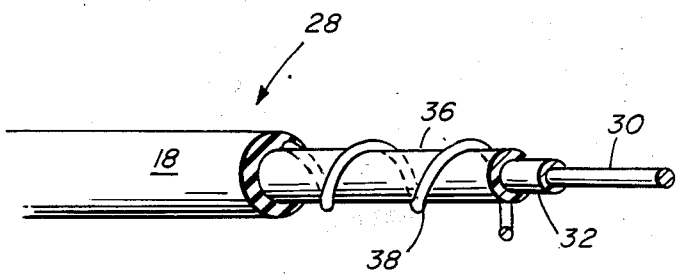
FIG. 2 shows another embodiment in which both a PTC composition and a conductive film are disposed between the first electrode and the second axially-wrapped electrode.

FIG. 2 presents a perspective view of a heating element 28 fabricated in accord with an alternate practice of the invention. Here, central electrode 30 is surrounded by and in contact with a thin layer of extruded PTC composition 32. Highly conductive film jackets the PTC composition 32, forming a conductive layer 36. Electrode wire 38 is wrapped helically about conductive layer 36, and in turn, is jacketed by insulation layer 18.

Operation of the alternate embodiment is similar to that of the embodiment shown in FIG. 1. Here, however, the current flows between the electrodes 30 and 38 via both the PTC composition 32 and the conductive film 36.

In the fabrication of a heating element according to the alternate practice of the invention presented in FIG. 2, a 26 gauge electrode wire is extrusion-coated with a PTC composition formulated as disclosed herein. The composition is applied to a thickness of not more than 0.020 inches and not less than 0.005 inches. A highly conductive thermoplastic film, with a thickness of approximately 0.010 inch, is then extruded over the PTC composition. This coated wire is annealed for 3 hours at 330° F. After annealing, the coated wire is irradiation cross-linked. Thereafter, a 32 gauge electrode wire, is spirally wound about the coated first wire. Finally, the assembly is jacketed, typically by extrusion, by an insulating layer. The resulting element is about 0.090 inches wide rather than the 0.500 inches of conventional prior art elements.

In one specific embodiment of the invention, constructed as discussed immediately above, a 26 gauge, 0.019 inch diameter center electrode is coated with a PTC composition having a volume resistively of 2,620,000 ohm-cm at operational equilibrium temperature. This PTC jacket is 0.010 inch thick. The area of contact between the center electrode and the wire is 0.716 $inch^2$ per foot. The resultant heating element, having a 14,400 ohm per foot PTC jacket resistance at operating temperature, has a power consumption of 1.0 watt.

The conductive thermoplastic film used in the embodiment of FIG. 2 comprises a polymer and a conductive filler. The polymer may be of the type discussed in connection with the insulating layer of the previous embodiment, i.e., a polyolefin, fluorocarbon polymer, terpolymer containing non-conjugated dienes, polypropylene, TPR, or polyester. However, to prevent sticking during the annealing of heating element reels, the polymer must have a melting point above the annealing temperature. In order to produce the desired conductivity, the polymer is blended with an electrically conductive filler material. This filler material can, again, be carbon black, making up as much as 40%, and not less than 20%, by weight of the conductive film blend.

The insulating material for this practice may be selected as discussed for the embodiment presented in FIG. 1. However, since the annealing step is performed prior to application of the insulating material, conventional low cost vinyl insulation can also be used.

The following non-limiting examples further illustrate the practice of the invention.

EXAMPLE 1

A PTC composition was mixed for 15 minutes on a 2-roll mill heated to 350° F. The composition comprised:

| | % By Weight |
|---|---|
| Fluorocarbon (Kynar 460), Melting Point: 334° F. | 68.0 |
| Polyethylene (NA-117), Density: .915, Melting Point: 190° F., | 6.4 |
| Pyrogenic Silica, (Cab-O-Sil) | 2 |
| 14% Carbon Black Dispersion in Polyethylene (Vulcan XC-72 in NA-117) | 22.6 |
| Antioxidant, (Irganox 1010) | 1.0 |
| | 100.0 |

A conductive film blend was prepared on a 2-roll mill heated to 450° F. and mixed for 15 minutes. The blend comprised:

| | % By Weight |
|---|---|
| High Melting Polyester Elastomer (Hytrel 5556) Melting Point: 412° F. | 69.0 |
| Conductive Carbon Black, (Vulcan XC-72) | 30.0 |
| Antioxidant, (Irganox 1010) | 1.0 |
| | 100.0 |

A 0.010 inch thick coating of the PTC composition was extrusion-coated onto preheated 26 gauge, 7 stranded tinned wire using a 2 inch extruder equipped with a polyethylene screw. Next, an 0.008 inch coating of the conductive film blend was extrusion-coated over the PTC composition using the same 2 inch extruder. One foot sections of the resultant wire product were annealed at 330° F. for 1 hour.

During annealment, test samples of the wire were placed in both straight and 1 inch diameter coil configurations. The coil configuration was used since the central electrode wire placed continuous stress on the surrounding PTC composition during annealing, thus testing the composition's softening and deformation characteristics. The straight configuration test samples served as a control for the experiment. Visual examination and resistance testing performed after overnight cooling indicated that the PTC composition did not soften or deform during the annealment of either configuration.

Qualitative analysis of the annealed wire sections was performed by wrapping one foot sections of annealed PTC wire with 32 gauge copper wire, wound to 8 wraps per inch. One multimeter lead was connected to an uncovered end of the PTC covered wire section, while the other lead was connected to the outer copper wire. In this manner, the resistance of the PTC composition of a section of the straight wire configuration was measured at 500 ohms, while that of the section from the coil configuration was no lower in resistance. In this coiled configuration, if the PTC composition softened during annealing, it would allow the center wire to move toward the conductive outer coating resulting in a significantly lower resistance. This test provided further evidence that the PTC composition of the invention was non-deforming at annealing temperatures.

A heating element was fabricated from the coated wire extrudate, prepared as above, by first annealing an aluminum foil wrapped reel for 3 hours at 330° F. The aluminum foil served to minimize evaporation and temperature fluctuations. After annealing, the reel could be unwound without difficulty. PTC resistance measured through 1 foot sections of the annealed wire, was 2,000 ohms, while, prior to annealing, the resistance had been measured to be greater than 20 million ohms.

Following annealment, the wire was irradiation cross-linked and spirally wound with 32 gauge copper wire. The per-foot weight of the wound wrap was set equivalent to the per-foot weight of the inner, axial wire. Finally, PVC insulation was extruded over the wire-wound product.

The resultant product was a smaller, more flexible, and more uniformly heating self-regulating electric heating element then has been produced heretofore.

EXAMPLE 2

A PTC composition was prepared on a 2-roll mill heated to 350° F. and mixed for 15 minutes. The composition comprised:

| | % By Weight |
|---|---|
| Polypropylene (El Paso's PP-31S3A) Melting Point: 335° F. | 54.0 |
| Polyethylene (NA-117), Density: .915, Melting Point: 190° F. | 7.0 |
| 14% Carbon Black Dispersion in Polyethylene (Vulcan XC-72 in NA-117) | 38.0 |
| Antioxidant (Irganox 1010) | 1.0 |
| | 100.0 |

A conductive film blend was prepared on a 2-roll mill heated to 450° F. and mixed for 15 minutes. The blend comprised:

| | % By Weight |
|---|---|
| High Melting Polyester Elastomer (Hytrel 5556) Melting Point: 412° F. | 69.0 |
| Conductive Carbon Black, (Vulcan XC-72) | 30.0 |
| Antioxidant, (Irganox 1010) | 1.0 |
| | 100.0 |

A 0.010 inch thick coating of the PTC composition was extrusion-coated onto preheated 26 gauge, 7 stranded tinned wire using a 2 inch extruder equipped with a polyethylene screw. Next, an 0.008 inch coating of the conductive film blend was extrusion-coated over the PTC composition using the same 2 inch extruder. One foot sections of the resultant wire product were annealed at 330° F. for 1 hour.

During annealment, test samples of the wire were placed in both straight and 1 inch diameter coil configurations. The coil configuration was used since the central electrode wire placed continuous stress on the surrounding PTC composition during annealing, thus testing the composition's softening and deformation characteristics. The straight configuration test samples served as a control for the experiment. Visual examination and resistance testing performed after overnight cooling indicated that the PTC composition did not soften or deform during the annealment of either configuration.

Qualitative analysis of the annealed wire sections was performed by wrapping one foot sections of annealed PTC wire with 32 gauge copper wire, wound to 8 wraps per inch. One multimeter lead was connected to an uncovered end of the PTC covered wire section, while the other lead was connected to the outer copper wire. In this manner, the resistance of the PTC composition of a section of the straight wire configuration was measured at 2000 ohms, while that of the section from the coil configuration was no lower in resistance. In this coiled configuration, if the PTC composition softened during annealing, it would allow the center wire to move toward the conductive outer coating resulting in a significantly lower resistance. This test provided further evidence that the PTC composition of the invention was non-deforming at annealing temperatures.

A heating element was fabricated from the coated wire extrudate, prepared as above, by first annealing an aluminum foil wrapped reel for 3 hours at 330° F. The aluminum foil served to minimize evaporation and temperature fluctuations. After annealing, the reel could be unwound without difficulty. PTC resistance measured through 1 foot sections of the annealed wire, was 2,900 ohms, while, prior to annealing, the resistance had been measured to be greater than 20 million ohms.

Following annealment, the wire was irradiation cross-linked and spirally wound with 32 gauge copper wire. The per-foot weight of the wound wrap was set equivalent to the per-foot weight of the inner, axial wire. Finally, PVC insulation was extruded over the wire-wound product.

The resultant product was a smaller, more flexible, and more uniformily heating self-regulating electric heating element then has been produced heretofore.

The embodiments of the heating element discussed above, and shown in FIGS. 1 and 2, are illustrative only. Other embodiments are within the scope of the following claims.

What is claimed is:

1. A temperature self-regulating resistive heating element comprising:

A. first and second conductive electrodes spaced-apart by not more than 0.100 inch; and B. a PTC composition disposed between, and in electrical communication with, said conductive electrodes, said PTC composition comprising a mixture of a first crystalline polymer, a second crystalline polymer, and a conductive filler material, said first and second polymers being at least partially incompatible and having melting point at least 20° F. apart.

2. The heating element of claim 1 wherein said first and second polymers are of at least 20% crystallinity.

3. The heating element of claim 1 wherein the melting point of said second polymer is at least 50° F. above that of said first polymer.

4. The heating element of claim 1 wherein said conductive filler material includes carbon black.

5. The heating element of claim 4 where said conductive carbon black comprises not more than 25% by weight of said PTC composition.

6. The heating element of claim 1 wherein said first and second polymers are selected from a group consisting of polyolefins, fluorocarbon polymers, and terpolymers containing non-conjugated dienes.

7. The heating element of claim 1 wherein said first polymer is a polyolefin and said second polymer is a halogenated polyolefin.

8. The heating element of claim 1 wherein said first polymer is low density polyethylene and said second polymer is selected from the group consisting of polytetrafluoroethylene, fluorinated copolymers of ethylene/propylene, polychlorotrifluoroethylene, poly (ethylene-chlorotrifluoroethylene), fluorinated polyvinylidene, and polypropylene.

9. The heating element of claim 8 wherein said first polymer is polypropylene and said second polymer is selected from the group consisting of polytetrafluoroethylene, fluorinated copolymers of ethylene/propylene, polychlorotrifluoroethylene, and poly (ethylene-chlorotrifluoroethylene).

10. The heating element of claim 8 wherein said first polymer is low density polyethylene and said second polymer is selected from the group consisting of fluorinated polyvinylidene, fluorinated copolymers of ethylene/propylene, chlorotrifluoroethylene, poly (ethylene-chlorotrifluoroethylene), and polypropylene.

11. The heating element of claim 1 comprising an electrically conductive film disposed between said PTC composition and one of said conductive electrodes, said film being in electrical communication with said one conductive electrode and with said PTC composition.

12. The heating element of claim 11 wherein said conductive film has a melting point above that of both said polymers.

13. The heating element of claim 11 wherein said conductive film comprises a polymer containing less than 40% by weight carbon black.

14. The heating element of claim 1 further comprising an insulating material disposed about the combined said first electrode, said second electrode, and said PTC composition.

15. The heating element of claim 1 wherein said first electrode is disposed axially within an elongate PTC composition and said second electrode is wound about said elongate PTC composition.

16. The heating element of claim 15 further comprising an electrically conductive film disposed between said PTC composition and said wound second electrode and in electrical communication with said PTC composition and said second electrode.

17. The heating element of claim 15 further comprising an insulating material disposed about said second electrode and said PTC composition.

18. The heating element of claim 1 wherein said electrodes are substantially parallel to each other.

* * * * *